US005263455A

United States Patent [19]

Iwai et al.

[11] Patent Number: 5,263,455

[45] Date of Patent: Nov. 23, 1993

[54] FUEL INJECTION CONTROL APPARATUS FOR INTERNAL COMBUSTION ENGINE

[75] Inventors: Akira Iwai, Susono; Hiroshi Sawada, Gotenba, both of Japan

[73] Assignee: Toyota Jidosha Kabushiki Kaisha, Aichi, Japan

[21] Appl. No.: 917,335

[22] Filed: Jul. 23, 1992

[30] Foreign Application Priority Data

Jul. 31, 1991 [JP] Japan ..... 3-190499

[51] Int. Cl.[5] ..... F02M 51/00

[52] U.S. Cl. ..... 123/478

[58] Field of Search ..... 123/478, 480, 682; 364/431.06

[56] References Cited

U.S. PATENT DOCUMENTS 5,023,795 6/1991 Matsumura et al. ..... 123/478
5,080,071 1/1992 Minamitani et al. ..... 123/478
5,095,874 3/1992 Schnaibel et al. ..... 123/478

FOREIGN PATENT DOCUMENTS 61-129435 6/1986 Japan .
63-215848 9/1988 Japan .
3-67043 3/1991 Japan .

*Primary Examiner*—Raymond A. Nelli
*Attorney, Agent, or Firm*—Oliff & Berridge

[57] ABSTRACT

A fuel injection control apparatus for an internal combustion engine includes a basic injection quantity calculation unit for calculating a basic injection quantity on the basis of an intake air quantity and an engine speed. A deposit detection unit detects a deposit quantity indicating a quantity of deposit deposited in an air intake system of the internal combustion engine, the deposit containing carbon particles. A correction unit calculates a real injection quantity using the basic injection quantity and the deposit quantity when the internal combustion engine is operating in a steady state within a predetermined period after the internal combustion engine is started.

5 Claims, 13 Drawing Sheets

FUEL INJECTION CONTROL APPARATUS FOR INTERNAL COMBUSTION ENGINE

BACKGROUND OF THE INVENTION

1. Field of the Invention

The present invention generally relates to a fuel injection control apparatus for an internal combustion engine, and more particularly to a fuel injection control apparatus having a correction means for correcting the injection quantity on the basis of fuel deposited on a passage wall of an intake system of an internal combustion engine as well as evaporated fuel generated in such a manner that the fuel deposited on the passage wall evaporates. More specifically, the present invention is intended to efficiently control the injection quantity immediately after the engine is started.

2. Description of the Related Art

In general, when an internal combustion engine is operating in a steady state, a predetermined quantity of fuel is deposited on a passage wall of an intake system so that an equilibrium condition is maintained. There is a correlation between the quantity of fuel deposited on the passage wall (hereinafter referred to as a deposited fuel quantity and the quantity of intake air or an intake manifold pressure). As the intake air quantity increases (the intake manifold pressure increases), the deposited fuel quantity increases. Hence, when the intake air quantity changes from a small quantity to a large quantity (in other words, when the automobile is accelerated), a predetermined quantity of fuel which is part of the injection quantity is deposited on the intake passage wall so that the engine is changed to the equilibrium state. As a result, the injection quantity which is actually injected into a cylinder decreases by the deposited fuel quantity, and thus a mixture of air and fuel becomes lean. On the other hand, when the intake air quantity changes from a large quantity to a small quantity (in other words, when the automobile is decelerated), the fuel deposited on the passage wall is partially evaporated by an excessive quantity with respect to the deposited fuel quantity obtained in the equilibrium state. As a result, the injection quantity which is actually injected into the cylinder increases by the quantity of the evaporated fuel, and thus the mixture becomes rich.

Japanese Laid-Open Patent Publication No. 63-215848 has proposed an improvement intended to prevent deviations in the air-fuel ratio in transient states. According to this publication, a saturation quantity of fuel deposited on the intake passage wall in the steady state is calculated at predetermined intervals using the intake air quantity having a correlation with the deposited fuel quantity. Then, the difference between a saturation quantity obtained at present and a saturation quantity at the immediately previous time is calculated, and the deposited fuel quantity or the evaporated fuel quantity (a change in the deposited fuel quantity) is predicted. Thereafter, a fuel deposition correction quantity is calculated based on the deposited fuel quantity or the evaporated fuel quantity, and a basic injection quantity is corrected using the fuel deposition correction quantity. It can be seen from the above that the method disclosed in the above publication deems that the deposited fuel quantity obtained in the steady state before a transient state is in the saturated state. When the state of the engine changes to a transient state, a change in the deposited fuel quantity from the saturation quantity of fuel deposited on the intake passage wall in the steady state is calculated. Then, the basic injection quantity is corrected based on the results of the above calculation.

However, the above proposed method has the following disadvantages. When a deposit containing carbon particles is deposited on the intake passage (intake manifold) wall, the surface area of the intake manifold increases. This increases the quantity of fuel to be deposited, and hence it takes a long time to obtain the saturated state. Within a predetermined period after the internal combustion engine is started, fuel injections are carried out only a small number of times. This means that the saturation quantity of fuel in the steady state has not yet been deposited on the intake passage wall within the predetermined period after the engine is started. The above-mentioned proposed method calculates the fuel deposition correction quantity on the assumption that the saturation quantity in the steady state is deposited on the intake passage wall. However, in the above case, a quantity of fuel smaller than the saturation quantity is actually deposited on the intake passage wall. Hence, the mixture is lean, and drivability in the accelerating state within the predetermined period after the engine is started, is degraded.

SUMMARY OF THE INVENTION

It is a general object of the present invention to provide a fuel injection control apparatus for an internal combustion engine in which the above disadvantages are eliminated.

A more specific object of the present invention is to provide an internal combustion engine in which an increased quantity of fuel dependent on the deposited fuel quantity is calculated in the steady state obtained within only a predetermined period after the engine is started so that the saturation quantity of fuel is deposited on the intake passage wall.

The above objects of the present invention are achieved by a fuel injection control apparatus for an internal combustion engine comprising:

deposited fuel quantity calculating means for sequentially calculating a quantity of fuel deposited in an air intake system of the internal combustion engine in a stationary state on the basis of a value corresponding to a quantity of air taken in the air intake system and a speed of the internal combustion engine;

correction means for calculating a fuel deposition correction quantity on the basis of a difference between the quantity of fuel calculated this time and the quantity of fuel calculated at a previous time;

basic injection quantity calculation means for calculating a basic injection quantity on the basis of said value corresponding to the quantity of air taken in the air intake system and said speed of the internal combustion engine;

final injection quantity injection means for calculating a final injection quantity by correcting said basic injection quantity on the basis of the fuel deposition correction quantity and for injecting the final injection quantity of fuel into the internal combustion engine;

deposit detection means for detecting a quantity of a deposit deposited in the air intake system, said deposit containing carbon particles;

fuel increase correction means for increasing the basic injection quantity by an increased fuel quantity based on the quantity of the deposit; and control means for decreasing said increased fuel quantity used to correct the basic injection quantity when it is detected, within a predetermined period after the internal combustion engine is started, that the fuel increase correction means increases the basic injection quantity and the internal combustion engine is in an accelerating state.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENTS

Figure 1:
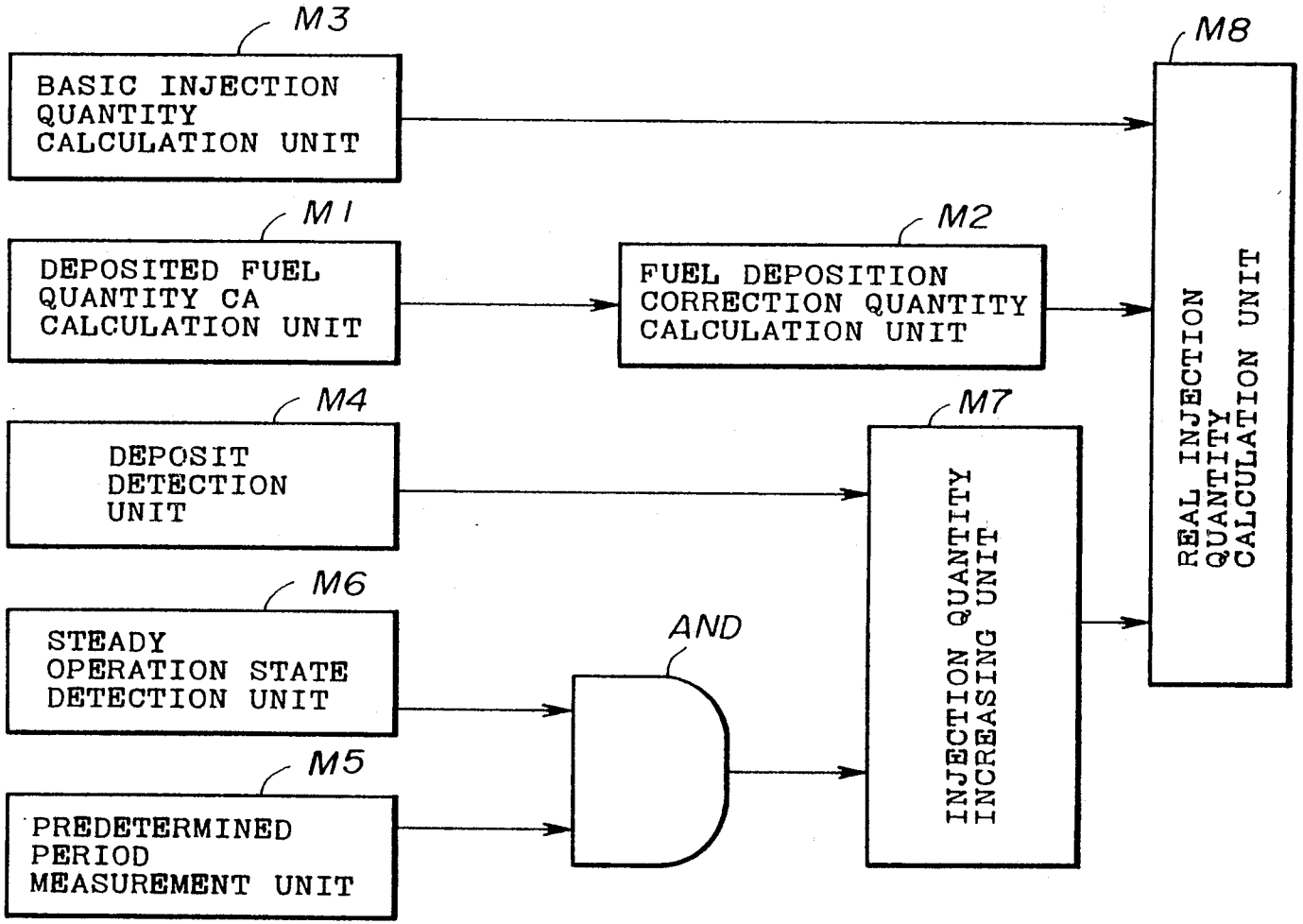
FIG. 1 is a block diagram illustrating an overview of a fuel injection control apparatus according to an embodiment of the present invention.

FIG. 1 shows an overview of a fuel injection control apparatus for an internal combustion engine according to an embodiment of the present invention. The fuel injection control apparatus shown in FIG. 1 is configured as follows. A deposited fuel calculation unit M1 periodically calculates a deposited fuel quantity in the steady state on the basis of a value corresponding to an intake air quantity and the revolution speed of the internal combustion engine. A fuel deposition correction quantity calculation unit M2 calculates a fuel deposition correction quantity for correcting the deposited fuel quantity on the basis of the difference between the deposited fuel quantity calculated at the present time and the deposited fuel quantity calculated at the previous time. A basic injection quantity calculation unit M3 calculates a basic injection quantity on the basis of the above value corresponding to the intake quantity and the engine speed.

A deposit detection unit M4 detects the quantity of deposit such as carbon particles deposited on an intake passage wall. A predetermined period measurement unit M5 detects the fact that the engine is operating within a predetermined period after the engine is started. A steady operation state detection unit M6 detects the fact that the engine is operating in the steady state. The output signals of the units M5 and M6 are applied to a logic gate AND, which generates a trigger signal when the engine is operating in the steady state within the predetermined period after the engine is started. In response to receipt of this trigger signal. An injection quantity increasing unit M7 calculates an additional fuel quantity based on the fuel deposit quantity detected by the deposit detection unit M4. A final injection quantity calculation unit M8 calculates a final injection quantity on the basis of the basic injection quantity calculated by the unit M3, the fuel deposition correction quantity calculated by the unit M2, and the increased injection quantity calculated by the unit M4. In this manner, the saturated quantity of fuel is deposited on the intake passage wall in the steady state even within the predetermined period after the engine is started. Hence, the mixture is maintained so that it has an appropriate air-fuel ratio even if the engine is changed to the accelerating state from the steady state.

Figure 2:
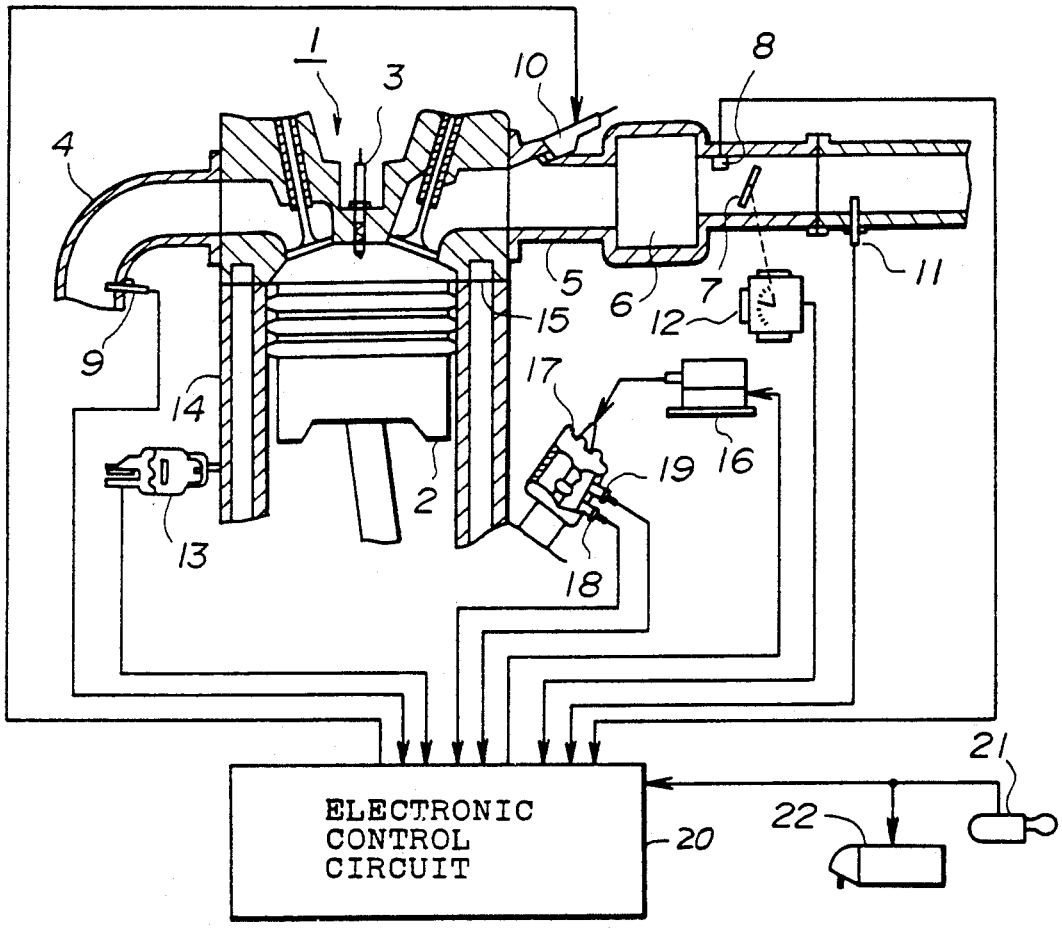
FIG. 2 is a diagram showing an engine body used in the embodiment of the present invention.

FIG. 2 shows an example of the internal combustion engine to which the present invention is applied. The internal combustion engine shown in FIG. 2 is configured as follows. The engine comprises a gasoline engine main body 1, a piston 2, an ignition plug 3, a exhaust manifold 4, and an intake manifold 5. A serge tank 6 absorbs a pulsation of the intake air. A throttle valve 7 adjusts the quantity of intake air. A negative-pressure sensor 8 measures an intake manifold pressure. An oxygen sensor 9 is fastened to the exhaust manifold 4. The oxygen sensor 9 detects the concentration of oxygen left in an exhaust gas in the exhaust manifold 4. A fuel injection valve 10 is fastened to the intake manifold 5. The fuel injection valve 10, which is fastened to the intake manifold 5, injects fuel into the intake air in the engine main body 1. An intake air temperature sensor 11, which is fastened to the intake manifold 5, measures the temperature of the intake air. A throttle sensor 12, which is fastened to the intake manifold 5, detects the opening angle of the throttle valve 7. A knocking sensor 13, which detects knocking, is fastened to a cylinder block inside the engine main body 1. A water temperature sensor 15, which detects the temperature of cooling water, is fastened to a water jacket.

An igniter 16 generates a high voltage necessary for ignition. A distributor 17 distributes the high voltage to ignition plugs for the cylinders in synchronism with rotation of a crank shaft (not shown). A turning angle sensor 18 outputs a turning angle signal NE consisting of 24 pulses each time the crank shaft makes two rotations. The two rotations of the crank shaft correspond to one rotation of the distributor 17. A cylinder identifying sensor 19 generates a rotation detection signal G of one pulse for one rotation of the distributor 17. An electronic control circuit 20 receives the signals from the above-mentioned sensors, and controls the entire fuel injection control apparatus. For example, the control circuit 20 generates a control signal to the fuel injection valve 10.

Figure 3:
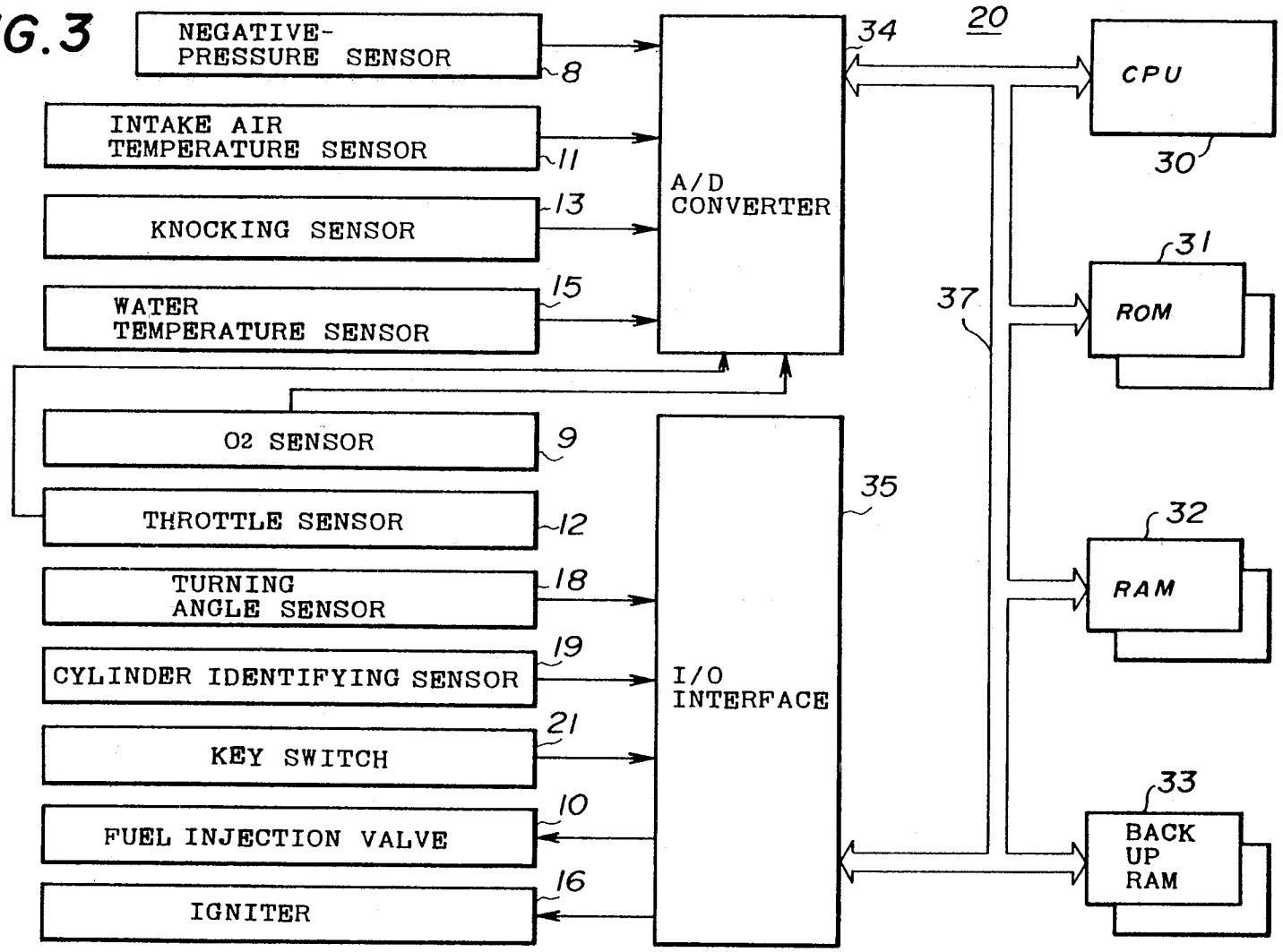
FIG. 3 is a block diagram of a control circuit shown in FIG. 2.

As shown in FIG. 3, the electronic control circuit 20 comprises a central processing unit (CPU) 30, a read only memory (ROM) 31 for storing processing programs, a random access memory (RAM) 32 used for working areas of the CPU 30, a battery-backup RAM 33 capable of storing data after the supply of electricity is stopped, an analog-to-digital (A/D) converter 34 having a multiplexing function, and an input/output (I/O) interface 35 having a buffering function.

The A/D converter 34 is supplied with an air flow rate signal from the negative-pressure sensor 8, an oxygen concentration signal from the oxygen sensor 9, an intake air temperature signal from the intake air temperature sensor 11, a throttle opening angle signal from the throttle sensor 12, a knocking signal from the knocking sensor 13, and a water temperature signal from the temperature sensor 15. Then, the A/D converter 34 converts the above signals into digital signals, which are read by the CPU 30. The I/O interface 35 is supplied with output signals of the turning angle sensor 18, the cylinder identifying sensor 19 and a key switch 21, all of which signals are read by the CPU 30. The CPU 30 calculates, on the basis of the signals from the sensors, an ignition timing and an injection quantity, which are respectively supplied to the igniter 16 and the fuel injection valve 10 via the I/O interface 35.

Figure 4:
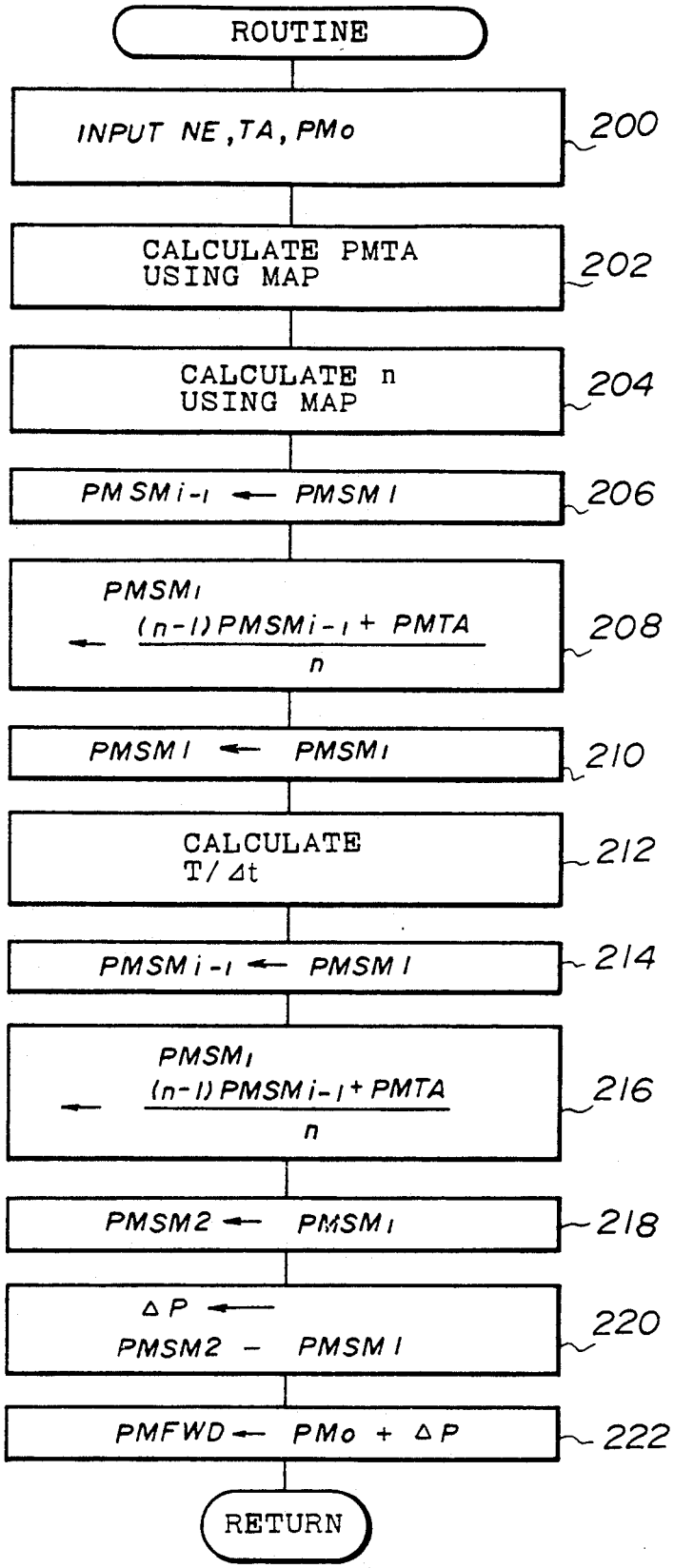
FIG. 4 is a flowchart of a process for calculating a predicted intake air quantity.
Figure 5:
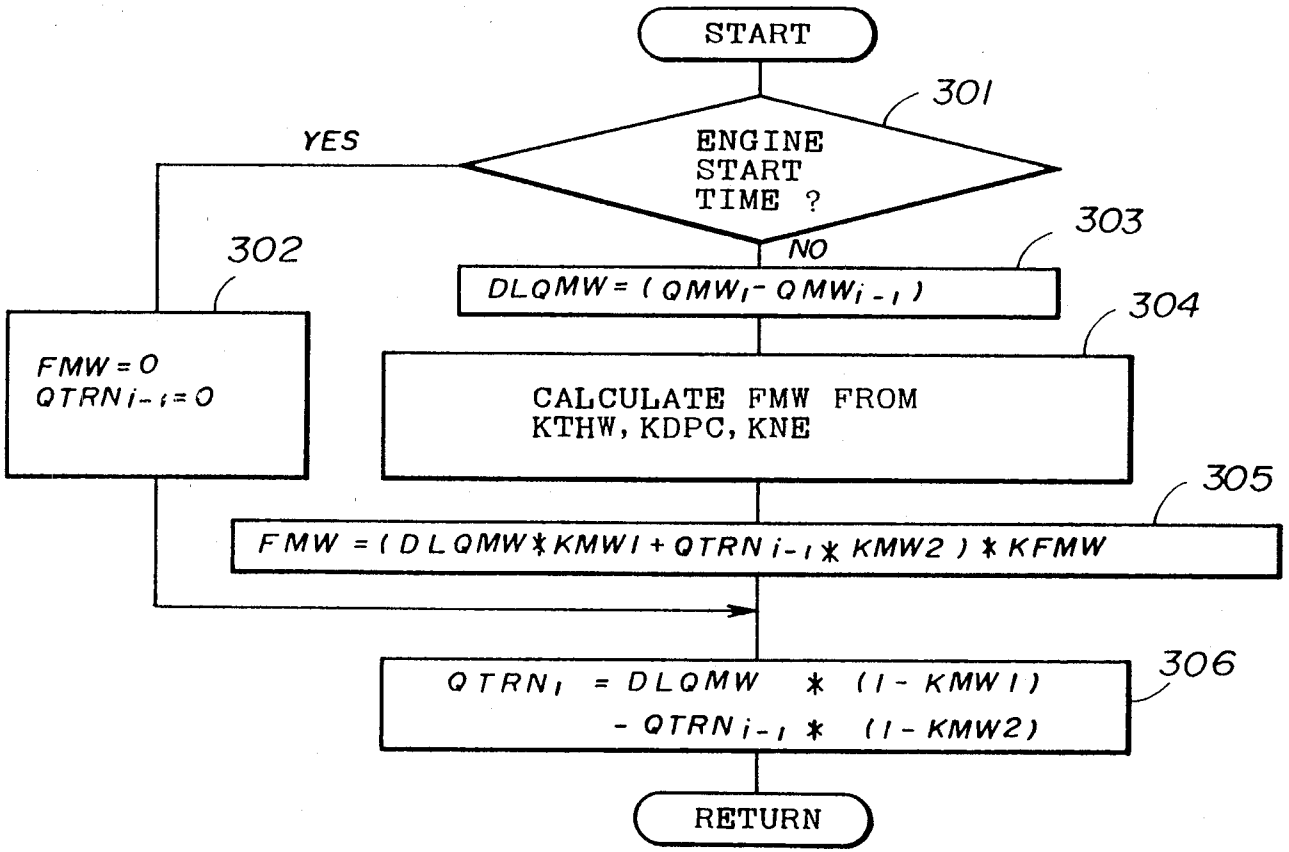
FIG. 5 is a flowchart of a process for calculating a deposited fuel correction quantity.
Figure 6:
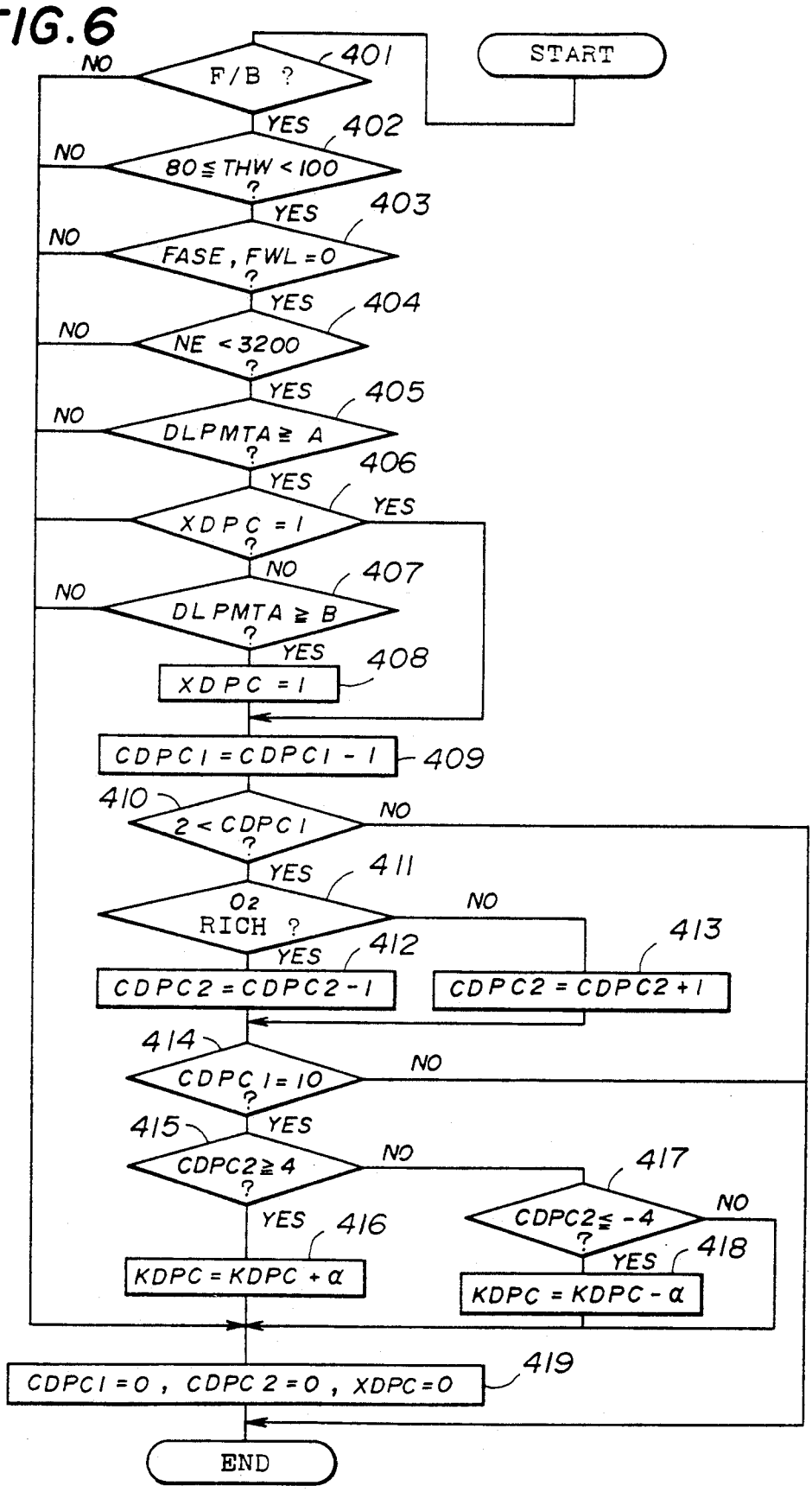
FIG. 6 is a flowchart of a process for calculating a deposited fuel quantity obtained by learning.
Figure 7:
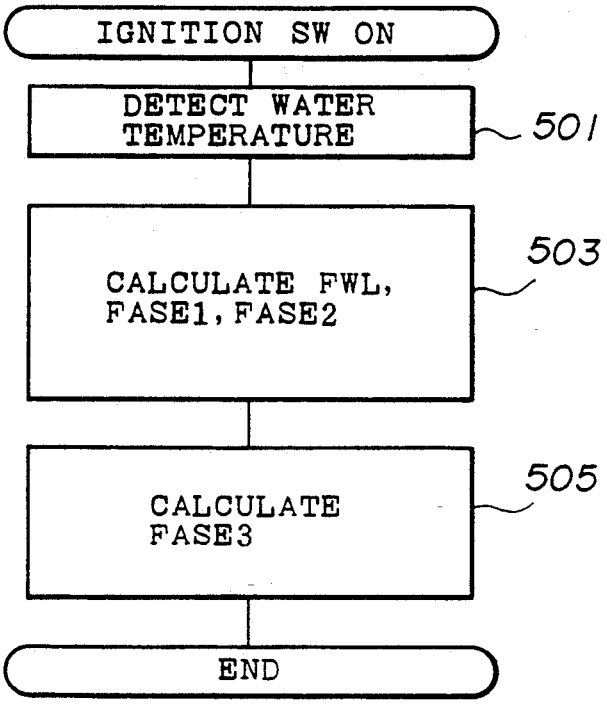
FIG. 7 is a flowchart of a process for calculating an initial value of an additional fuel quantity used when the engine is started.
Figure 8:
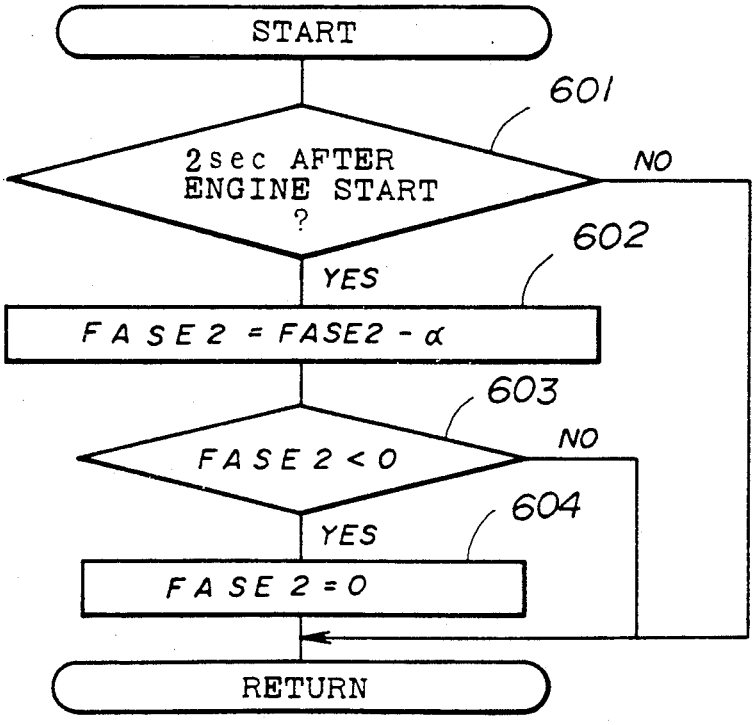
FIG. 8 is a flowchart of a process for calculating a second additional fuel quantity used after the engine is started.
Figure 9:
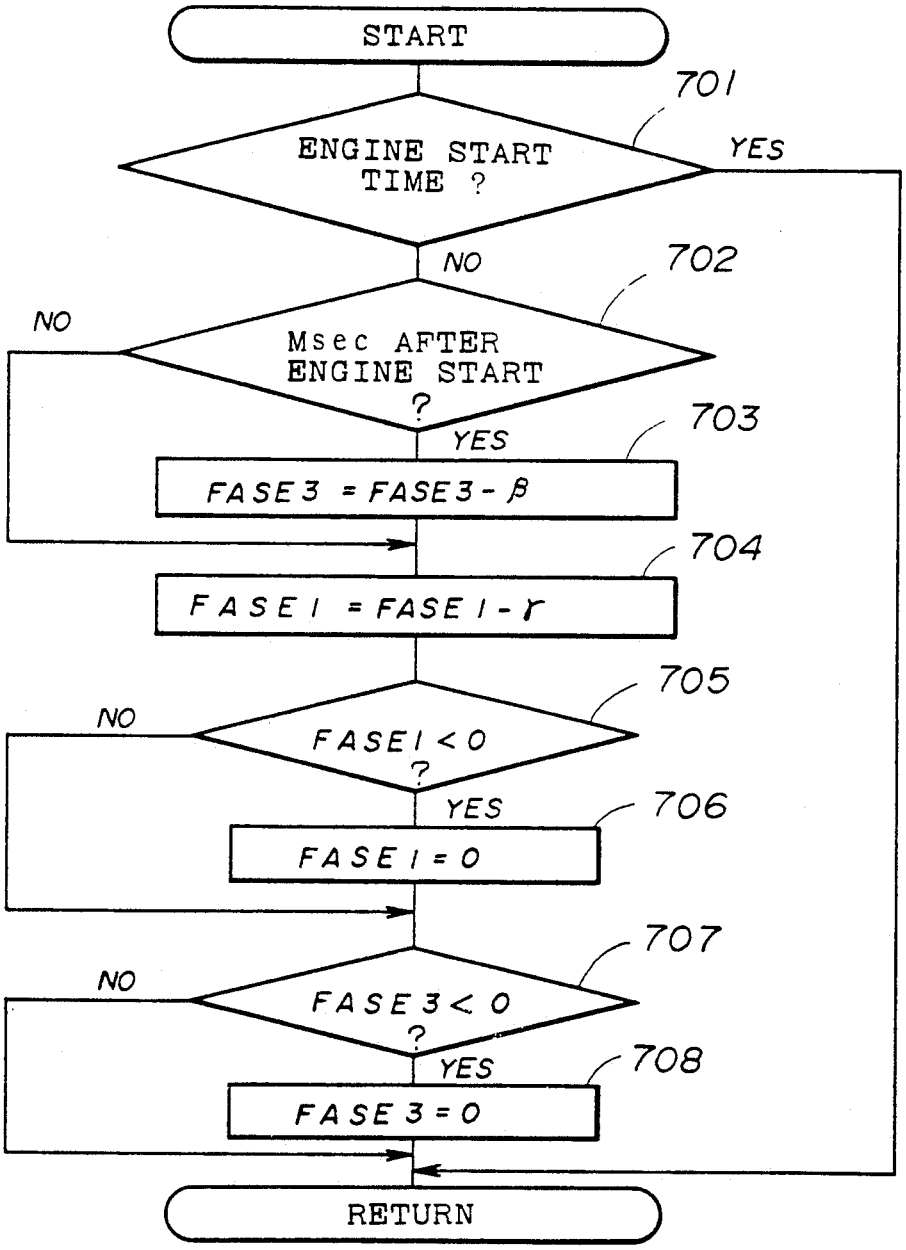
FIG. 9 is a flowchart of a process for calculating first and third additional fuel quantities used after the engine is started.
Figure 10:
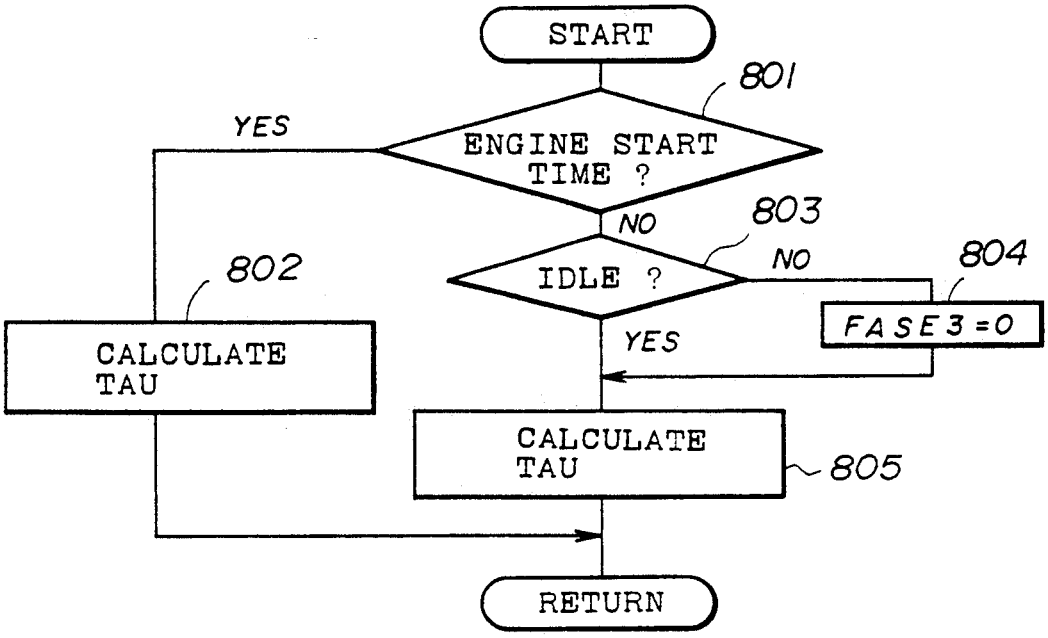
FIG. 10 is a flowchart of a process for calculating an injection quantity.

A description will now be given, with reference to FIGS. 4, 5, 6, 7, 8, 9 and 10, of the operation of the first embodiment of the present invention. FIG. 4 shows a predicted intake air quantity (predicted intake manifold pressure) calculation routine, and FIG. 5 shows a routine for calculating a fuel deposition correction quantity based on the quantity of fuel deposited on the intake manifold wall. FIG. 6 shows a deposit learning and calculation routine, and FIG. 7 shows a routine for setting an initial value of an additional fuel quantity used when the engine is started. FIG. 8 shows a routine for calculating a second additional fuel quantity FASE2 used after the engine is started, and FIG. 9 shows a routine for calculating first and third additional fuel quantities FASE1 and FASE3 used after the engine is started. FIG. 10 shows a routine for calculating an additional fuel quantity after the engine is started.

Figure 11:
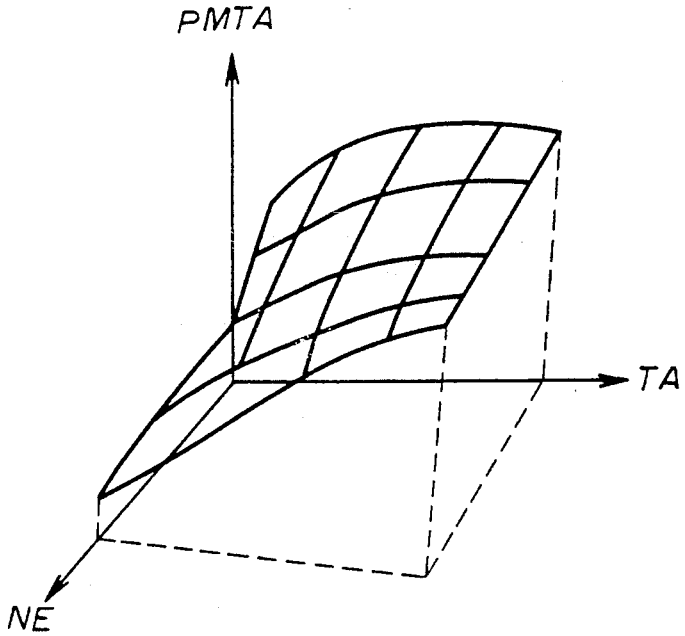
FIG. 11 is a graph showing a three-dimensional map for calculating an intake manifold pressure from the engine speed NE and the water temperature TA.
Figure 12:
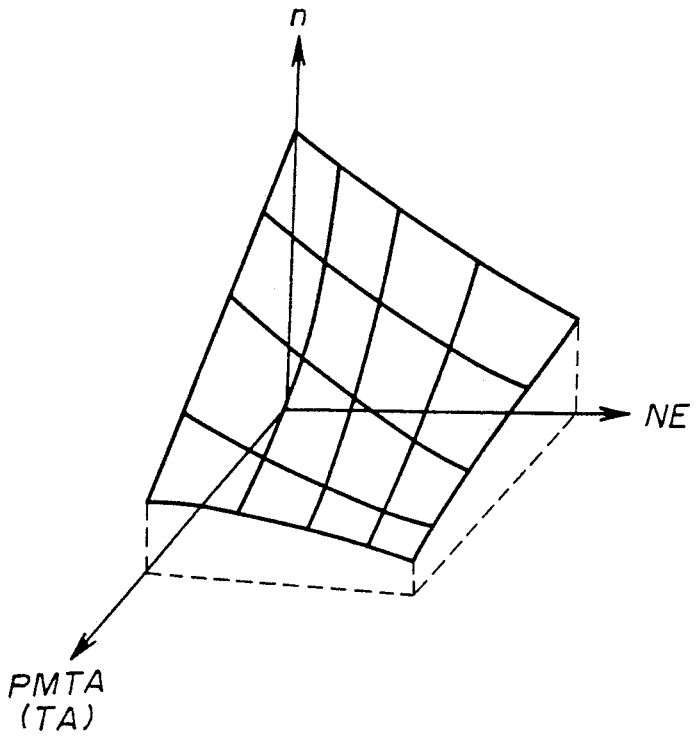
FIG. 12 is a graph showing a three-dimensional map for calculating a weight from the engine speed NE and the intake manifold pressure.

A description will first be given, with reference to FIG. 4, of a process for calculating a predicted intake manifold pressure PMFWD, which is used for calculating the basic injection quantity, labeled TP, and a fuel deposition correction quantity, labeled FMW. The routine shown in FIG. 4 is carried out at predetermined intervals (every 4 ms, for example). In step 200, the CPU 30 reads an engine speed signal NE, an A/D-converted throttle opening angle signal TA, and a current intake manifold pressure signal $PM_0$. In step 202, the CPU 30 obtains an intake manifold pressure PMTA in a steady state dependent on the engine speed NE and the throttle opening angle TA by using a map shown in FIG. 11. In step 204, the CPU 30 calculates a coefficient n related to weighting by using a map shown in FIG. 12. In steps 206 and 208, the CPU 30 reads a previously calculated weighted average value $PMSM_{i-1}$ stored in a register PMSM1, and calculates a new (updated) weighted average value $PMSM_i$ using expression (1):

$$PMSM_i=[(n-1)PMSM_{i-1}+PMTA]/n \quad (1).$$

In step 210, the CPU 30 stores the weighted average value $PMSM_i$ thus calculated in the register PMSM1.

Figure 13:
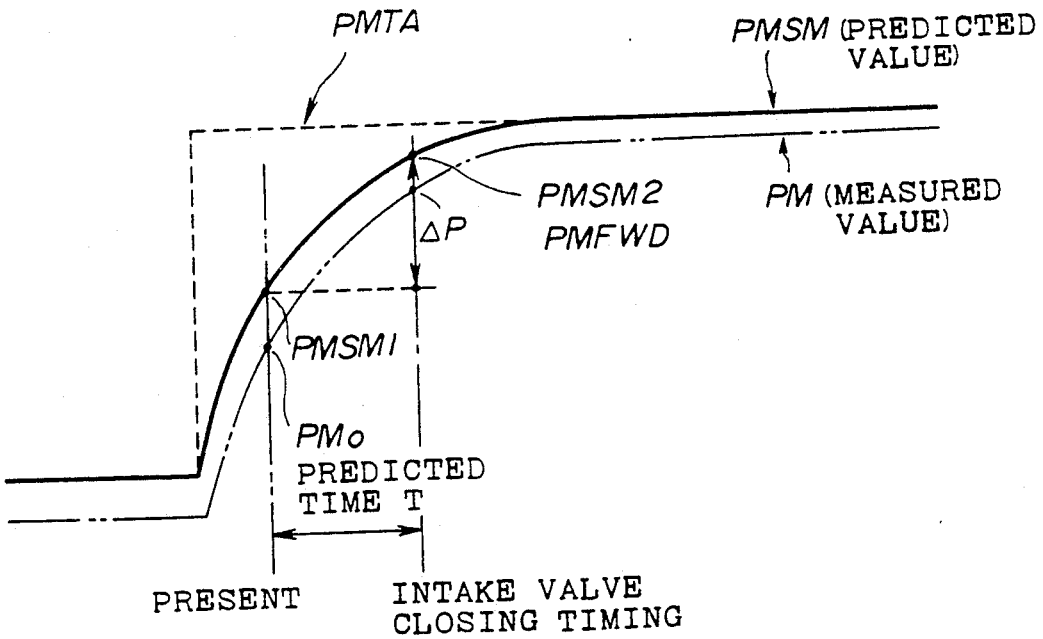
FIG. 13 is a graph showing the relationship between a predicted intake air quantity and the measured quantity.

In step 212, the CPU 30 divides the time Tmsec from the present time to an intake manifold pressure prediction time by the period $_{\Delta}t$ (=8 msec) of execution of the routine shown in FIG. 4. The result of this division indicates the number of times $T/_{66}t$ that the routine is repeatedly carried out. As shown in FIG. 13, the predicted time Tmsec may be the time from the present time to the time when the intake air quantity is settled, or may be the time from the present time to the time when the intake valve is closed. If fuel is not injected into the cylinders separately from each other, the predicted time Tmsec is determined taking into account the time necessary for fuel to reach an ignition chamber after it is simultaneously injected via the injection valves. The predicted time Tmsec becomes shorter as the engine speed increases, even for an identical crank angle corresponding to the difference between the present time and the time when the injection valve is closed. With the above in mind, it is preferable that the predicted time Tmsec be varied on the basis of the engine operating condition. For example, the predicted time Tmsec is shortened as the engine speed increases.

In step 214, the value stored in the register PMSM1 is substituted into the weighted average value $PMSM_{i-1}$. In step 216, the CPU 30 repeatedly executes the calculation defined by expression (1) $T/_{66}t$ times. In step 218, the CPU 30 stores each calculation result in a register PMSM2. By repeatedly executing the weighted averaging, the latest weighted average value becomes close to the intake manifold pressure value in the steady state. Hence, by determining, in the above-mentioned manner, the number of times that the weighted averaging is repeatedly carried out, it is possible to obtain a predicted intake manifold pressure value at the time ahead of the present time by Tmsec (the predicted intake pressure value being obtained in a state closer to the steady state than that at present).

In step 220, the CPU 30 subtracts the value stored in the register PMSM1 (the calculated intake manifold pressure PMSM1 at present) from the value stored in the register PMSM2 (the calculated intake manifold pressure PMSM2 at the predicted time). The result of this subtraction is denoted by $_{66}P$. In step 222, the CPU 30 adds the measured intake manifold pressure (the current measurement value) $PM_0$ and the difference $_{66}P$. The result of this addition is a predicted value PMFWD.

The quantity of fuel deposited in the intake manifold wall varies based on the engine operating condition. Hence, it is necessary to transiently supply the wall in the vicinity of the port with a fuel quantity corresponding to the difference between the actual deposited fuel quantity and the saturation quantity, the difference depending on the engine operating condition. The routine shown in FIG. 5 is intended to calculate the above difference. In step 301, the CPU 30 determines whether or not the engine is operating in the starting state. When the result of this determination is YES, the CPU 30 initializes the fuel deposition correction quantity FMW and an attenuation ratio Q (which will be described later) so that these parameters are set to be zero. When the result of the step 301 determination is NO, the process proceeds to step 303. The CPU 30 calculates the deposited fuel quantity $QMW_i$ by referring to Table 1 using the predicted value PMFWD calculated by the process shown in FIG. 4. As the negative pressure of the intake manifold decreases, the deposited fuel quantity increases. Then, the CPU 30 calculates the difference between the deposited fuel quantity $QMW_{i-1}$ obtained by the previous execution of the routine shown in FIG. 5 and the deposited fuel quantity $QMW_i$ obtained at the present time, the above difference corresponding to a changed quantity DLQMW of the deposited fuel. Table 1 defines the deposited fuel quantities QMW (μs) as a function of the changed quantity DLQMW (mmHg) when the engine is operating in the steady state.

TABLE 1

| PMFWD (mmHg) | 150 | 300 | 450 | 600 | 750 |
|---|---|---|---|---|---|
| QMW (μs) | 0 | 3000 | 6000 | 9000 | 12000 |

In step 304, the CPU 30 respectively reads, from Tables 2 and 3, a correction coefficient KTHW dependent on the water temperature and a correction coefficient KNE dependent on the engine speed.

TABLE 2

| THW (°C.) | −25.0 | −10.0 | 5.0 | 15.0 | 30.0 | 50.0 | 70.0 |
|---|---|---|---|---|---|---|---|
| KTHW | 18.0 | 16.0 | 15.0 | 9.0 | 8.5 | 8.0 | 0.0 |

TABLE 3

| NE (rpm) | 800 | 4000 |
|---|---|---|
| KNE | 1.0 | 0.6 |

The CPU 30 calculates a correction quantity KFMW defined below by using the above correction coefficients KTHW and KNE, and a deposit learning value KDPC obtained by executing the routine (learning) shown in FIG. 6:

$$KFMW=1+(KTHW+KDPC)*KNE$$

where * denotes multiplication.

In step 305, the CPU 30 calculates the fuel deposition correction quantity FMW in the following manner. When the intake air quantity increases, a predetermined quantity of fuel which is part of the injection quantity is deposited on the intake manifold wall so that the equilibrium condition is obtained. The quantity of fuel deposited until the equilibrium condition is obtained can be calculated from the difference between the deposited fuel quantity $QMW_{i-1}$ obtained by the previous execution of the routine shown in FIG. 5 and the deposited fuel quantity $QMW_i$ obtained by the present execution thereof. However, the correction quantity $(QMW_i-QMW_{i-1})$ is not deposited at one time but is gradually deposited so that the deposited fuel gradually shifts to the equilibrium state. With the above in mind, the CPU 30 refers to Table 4 and obtains the ratio KM1 of fuel deposited during the present execution to the above correction quantity. Then, the CPU 30 calculates the quantity of fuel deposited during the present execution of the routine, that is, $(QMW_i-QMW_{i-1})*KM1$. Further, the CPU 30 refers to Table 5 and calculates the quantity of fuel which was not deposited during the previous execution, $QTRN_i*KM2$ where $QTRN_i$ denotes an attenuation term.

TABLE 4

| NE (rpm) | 1200 | 2000 | 2800 |
|---|---|---|---|
| KM1 | 0.20 | 0.25 | 0.26 |

TABLE 5

| NE (rpm) | 1200 | 2000 | 2800 |
|---|---|---|---|
| KM1 | 0.09 | 0.09 | 0.095 |

The CPU 30 adds the two quantities $(QMW_i-QMW_{i-1})*KM1$ and $QTRN_i*KM2$, the result of this addition being the correction quantity by which the injection quantity should be corrected. Further, the CPU 30 multiplies the above correction quantity by the aforementioned correction quantity KFMW (dependent on the water temperature and the engine speed) obtained at step 304. The result of this multiplication is the fuel deposition correction quantity FMW for correcting the basic injection quantity:

$$FMW=\{(QMW_i-QMW_{i-1})*KM1+QTRN_i*KM2)*KFMW.$$

In step 306, the CPU 30 calculates the attenuation term $QTRN_i$ used in the above expression. The attenuation term $QTRN_i$ is used for the next execution of the routine and defined as follows:

$$QTRN_i=QTRN_{i-1}*(1-KM2)+(QMW_i-QMW_{i-1})*(1-KM1).$$

A description will now be given, with reference to FIG. 6, of the calculation method (deposit learning routine) for calculating the deposit learning value KDPC.

In steps 401–405, the CPU 30 determines whether the deposit learning routine should be carried out. The deposit learning routine is executed when all of the following three conditions are satisfied. The first condition is that the water temperature in the F/B (feedback) control is between 80° C. and 100° C. The second condition is that neither a fuel increasing after the engine starts nor a warm-up increasing of fuel is carried out and the engine speed is lower than a predetermined engine speed (equal to, for example, 3200 rpm). The third condition is that a change DLPMTA in the intake manifold pressure PMTA is larger than a predetermined value A, that is, the engine speed is accelerating at a predetermined acceleration or higher. When all the above three conditions are satisfied, the CPU 30 executes step 406. Even if only one of the three conditions is not satisfied, the CPU 30 initializes counter values CDP1, CDP2 and a flag XDPC in step 419 so that CDP1=0, CDP2=0 and XDPC=0. In this case, the deposit learning process is not carried out.

In step 406, the CPU 30 determines whether or not the flag XDPC is equal to 1. When the deposit learning process is being executed (XDPC=1), the CPU 30 skips steps 407 and 408. When the deposit learning process is not being carried out (XDPC=0), the CPU step 407, in which step a deposit learning starting condition is defined. In step 407, the CPU 30 determines whether or not a change DLPMTA in the intake manifold pressure PMTA is equal to or larger than a predetermined value B. When it is determined that the throttle opening angle is not rapidly increasing (DLPMTA<B; A<B), the above initialization step 419 is executed. On the other hand, when it is determined, in step 407, that the throttle opening angle is rapidly increasing (DLPMTA≧B), the CPU 30 starts the deposit learning process, and sets the flag XDPC to 1 in step 408.

In step 409, the CPU 30 increments, by 1, a time counter CDPC1, which indicates the time after the deposit learning process is started. In step 410, the CPU 30 determines whether or not the time counter CDPC1 indicates a value larger than 2. When the time counter CDPC1 indicates 1, the CPU 30 understands that the accelerating of the engine has just been started and a gas resulting from ignition has not yet reached the oxygen sensor 9 in the exhaust manifold 4. In this case, the CPU 30 ends the routine shown in FIG. 6. When it is determined, in step 410, that CDPC>2, the CPU 41 executes step 411, in which step it is determined, by referring to the output signal of the oxygen sensor 9, whether the mixture is rich or lean. When it is determined that the mixture is rich, the CPU 30 executes step 412, in which step the value indicated by a rich/lean decision counter CDPC2 is decreased by 1. When it is determined that the mixture is lean, the CPU 30 executes step 413, in which step the value of the rich/lean decision counter CDPC2 is incremented by 1.

In step 414, the CPU 30 determines whether or not step 412 or 413 is executed 10 times in total (in other words, it is determined whether or not CDPC1=10). When it is determined that CDPC1=10, the CPU 30 executes step 415, in which it is determined whether or not the value of the counter CDPC2 is equal to or larger than 4. When it is determined that CDPC2≧4, the CPU 30 understands that the mixture in the accelerating state is lean and a large quantity of carbon deposit is deposited on the intake manifold wall. This is because that as the quantity of fuel deposit increases, the surface area of the intake manifold increases and a large quantity of fuel is deposited on the wall thereof. When it is determined that the mixture is lean, the deposit learning value KDPC obtained by the learning is increased by a predetermined value $\alpha$ in step 416. When it is determined, in step 416, that CDPC2<4 the CPU 30 executes step 417, in which step it is determined whether or not CDPC2≦−4, that is, it is determined whether or not the mixture is rich. When it is determined that the mixture is rich, the deposit learning value KDPC is decreased by the predetermined value $\alpha$ in step 418. When the counter value CDPC2 is a value between −4 and 4, the deposit learning value KDPC obtained by the learning is maintained without change. In this manner, the deposit learning value KDPC used after the learning is updated on the basis whether the mixture is rich or lean. The deposit learning value KDPC is stored in the backup RAM 33, and is not lost after the engine is stopped. Finally, the CPU 30 executes the initialization process in step 419.

A description will now be given, with reference to FIG. 7, of a routine for setting the initial value of the additional fuel quantity used when the engine is started. In step 501, the CPU 30 detects the water temperature when the ignition switch is turned ON. In step 503, the CPU 30 refers to Tables 6, 7 and 8, and calculates the initial values of an additional warm-up fuel quantity FWL, the first additional fuel quantity FASE1 used after the engine is started, and the second additional fuel quantity FASE2 used after the engine is started.

TABLE 6

| THW (°C.) | −25 | −10 | 5 | 15 | 30 | 45 | 70 |
|---|---|---|---|---|---|---|---|
| FWL | 0.55 | 0.45 | 0.35 | 0.25 | 0.15 | 0.1 | 0 |

TABLE 7

| THW (°C.) | −25 | −10 | 5 | 15 | 30 | 45 | 70 |
|---|---|---|---|---|---|---|---|
| FWL | 2.0 | 1.0 | 0.75 | 0.5 | 0.3 | 0.2 | 0.05 |

TABLE 8

| THW (°C.) | −30 | −10 | 2 | 15 | 25 | 40 |
|---|---|---|---|---|---|---|
| FWL | 3 | 2 | 2 | 1.5 | 1.0 | 0 |

Figure 14:
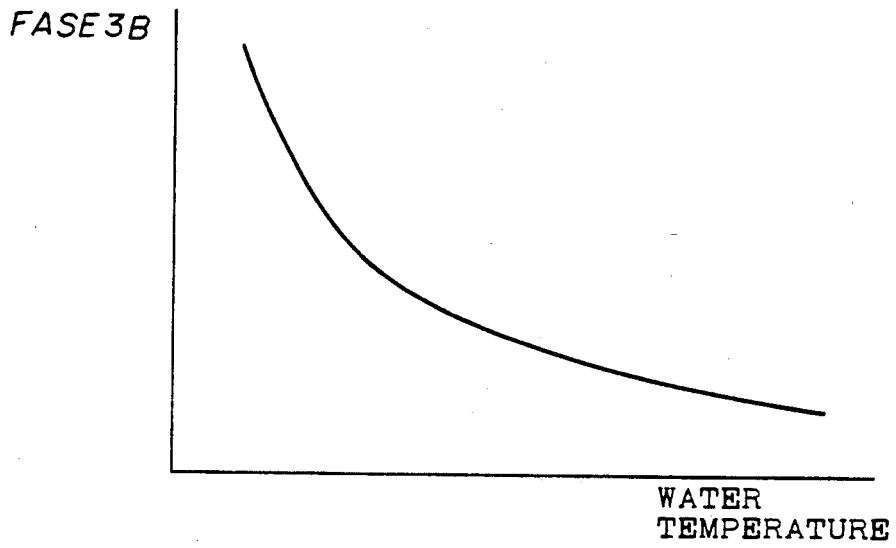
FIG. 14 is a graph showing a two-dimensional map between the water temperature and the third additional fuel quantity.
Figure 15:
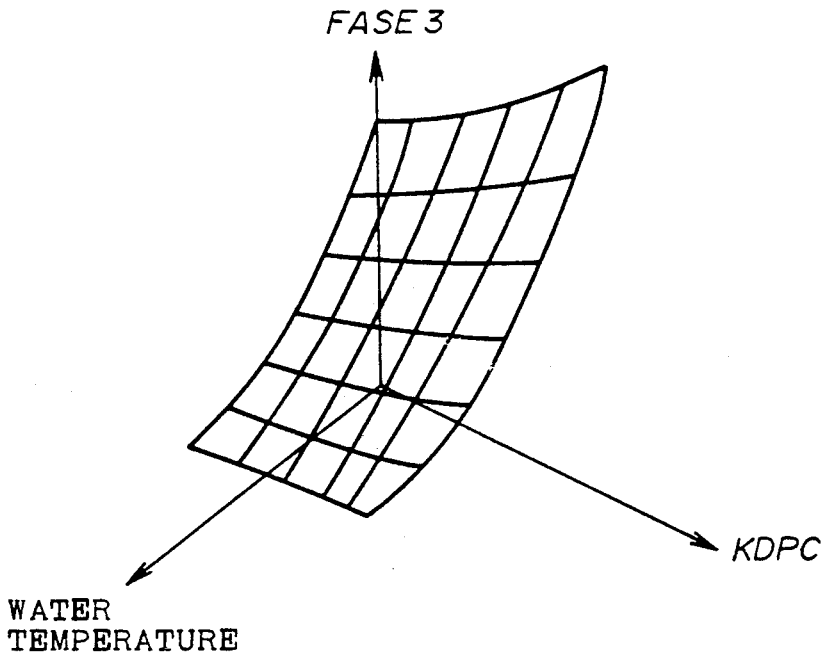
FIG. 15 is a graph showing a three-dimensional map for calculating the deposited fuel quantity obtained by the learning and the water temperature.

In step 505, the CPU 30 calculates the initial value of the third additional fuel quantity FASE3 after the engine is started by using the following expression:

FASE3=FASE3B*KDPC where FASE3B is a value obtained from a two-dimensional map (graph) shown in FIG. 14 by accessing it by means of the water temperature. Alternatively, it is also possible to obtain the third additional fuel quantity FASE3 by referring to a three-dimensional map (graph) shown in FIG. 15 by accessing it by means of the water temperature as well as the deposit learning value KDPC obtained by the learning.

A description will now be given, with reference to FIG. 8, of attenuating the second additional fuel quantity FASE2 from its initial value set when the engine is started. In step 601, the CPU 30 determines whether or not two seconds have elapsed after the engine is started. When the result of this determination is NO, the CPU 30 terminates this routine. When the result of this determination is YES, the CPU 30 executes step 602, in which step a predetermined quantity $\alpha$ is subtracted from the second additional fuel quantity FASE2 used after the engine is started. The routine shown in FIG. 7 is repeatedly carried out every 32 ms. Hence, when two seconds have elapsed after the engine is started, the second additional fuel quantity FASE2 starts to be gradually decreased. When the second additional fuel quantity FASE2 becomes zero, it is maintained at zero.

Figure 16:
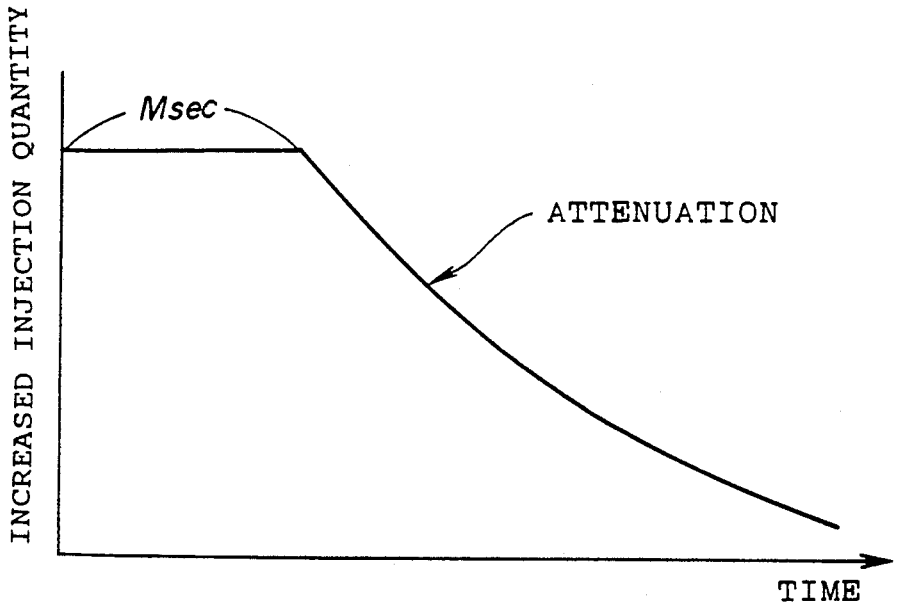
FIG. 16 is a graph showing how the fuel injection is initially increased and then decreased after the engine is started.
Figure 17:
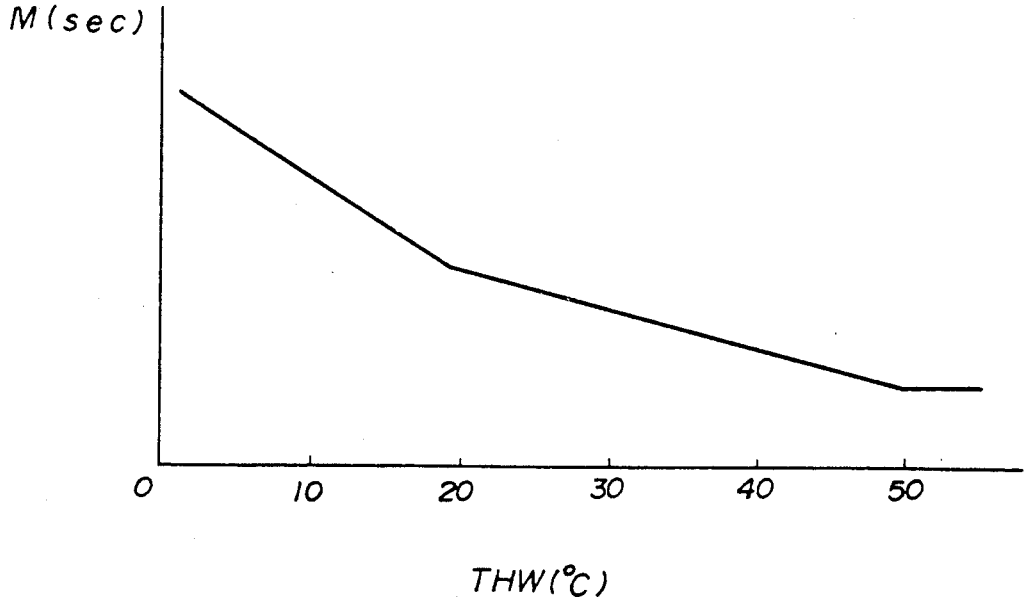
FIG. 17 is a graph showing the relationship between time and the water temperature.

Similarly, the first and third additional fuel quantities FASE1 and FASE3 are gradually decreased from the respective initial values in accordance with the attenuation routine shown in FIG. 9. The routine shown in FIG. 9 is activated for each rotation. In step 701 shown in FIG. 9, the CPU 30 determines whether or not the engine is in the starting state. When the result of this determination is YES, the CPU 701 terminates this routine. In the other case, the CPU 30 determines, in step 702, whether or not M seconds have elapsed after the engine was started. When the result of this determination is NO, the CPU skips step 703. Hence, the third additional fuel quantity FASE3 is maintained at the current value (see FIG. 16). After two seconds have elapsed after the engine is started, the CPU 30 executes step 703, in which step a predetermined quantity $\beta$ is subtracted from the third additional fuel quantity FASE3. The first additional fuel quantity FASE1 is decreased, in step 704, by a predetermined value $\tau$ each time the routine is executed immediately after the engine is started. As shown in FIG. 17, the time M after the engine is started is changed in accordance with the water temperature. Steps 705–708 function to prevent the first and third additional fuel quantities FASE1 and FASE3 from becoming equal to or smaller than zero.

FIG. 10 shows an injection quantity calculation routine different from the injection quantity calculation routine shown in FIG. 7. In step 801 shown in FIG. 10, the CPU 30 determines whether or not the engine is in the starting state. When the result of this determination is YES, the CPU 30 calculates an injection quantity TAU defined by the following expression and used when the engine is started, and ends this routine:

$$TAU = TAUST * KNEST$$

where TAUST is calculated from the water temperature, and KNEST is calculated from the engine speed. When the engine is not in the starting state, the CPU 30 determines, in step 803, whether or not the engine is operating in the idle state. When the engine is not in the idle state, the CPU 30 sets the first additional fuel quantity FASE3 to be zero in step 804. When the engine is operating in the idle state, in step 805 the CPU 30 calculates the injection quantity taking into account the third additional fuel quantity FASE3 obtained by the execution of the routine shown in FIG. 9.

In step 805, the following expression is calculated:

$$TAU = TP*(FASE1 + FASE2 + FASE3 + FWL + \Phi) + FMW.$$

That is, the basic injection quantity TP is calculated using the predicted intake air quantity PMFWD and the engine speed NE. Then, the first, second and third additional fuel quantities FASE1, FASE2 and FASE3, and the additional fuel quantity FWL used when the engine is operating in the warm-up state. The term $\Phi$ denotes another correction coefficient. Further, the fuel deposition correction quantity FMW is added.

Figure 18:
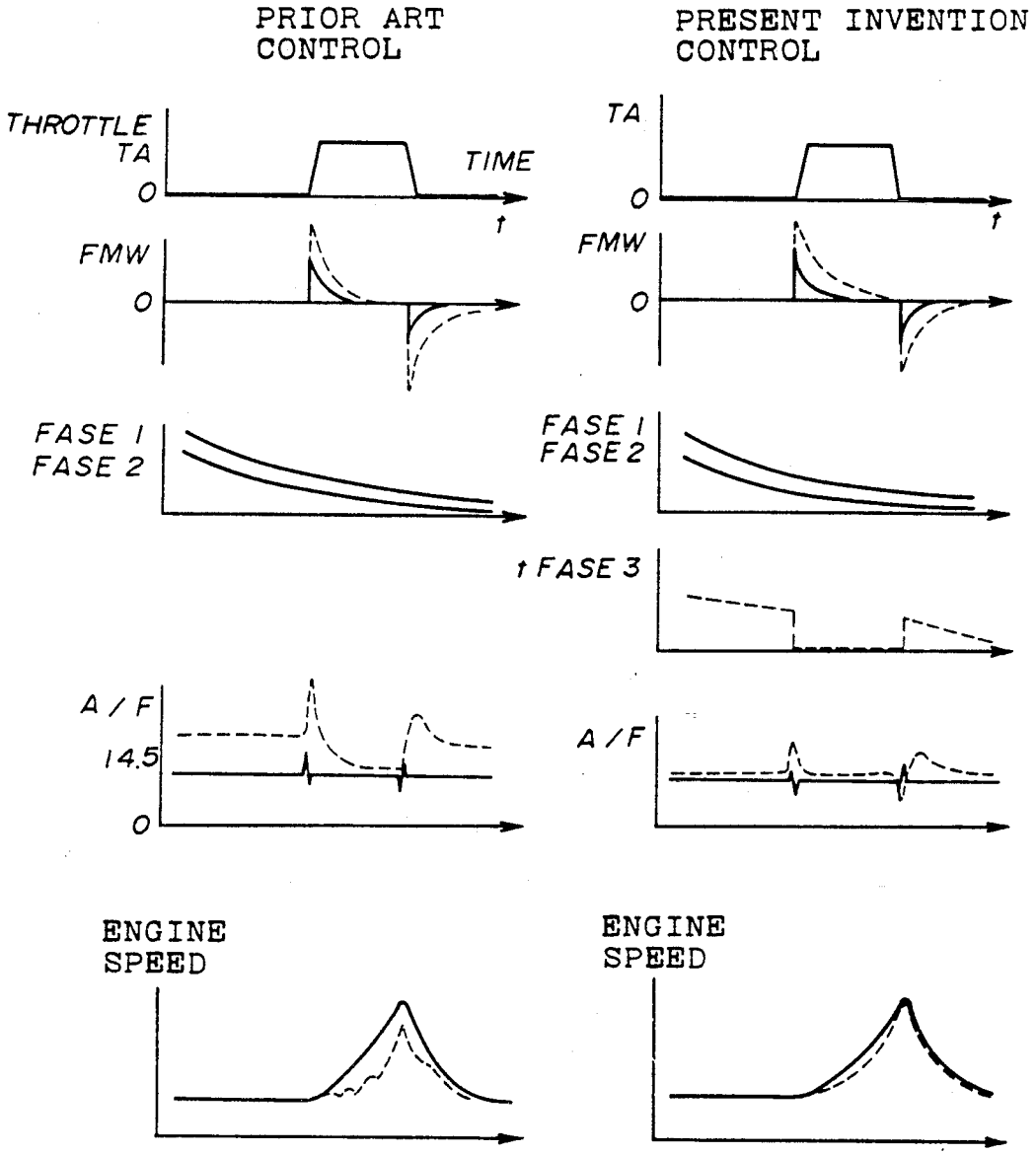
FIG. 18 is a diagram comparing the present invention with the prior art.

Referring to FIG. 18, the air-fuel ratio (indicated by a solid line) is good even in the prior art when carbon deposit is not deposited on the intake manifold wall. However, the air-fuel ratio (indicated by a dotted line) is not good in the prior art when fuel is deposited on the intake manifold wall. That is, according to the prior art, the mixture is regulated so as to be lean, particularly, when the engine is accelerated. Further, the engine speed cannot increase smoothly, thus deteriorating drivability. On the other hand, according to the present embodiment, by using the third additional fuel quantity FASE3 in the steady state within the predetermined period after the engine is started, the mixture is prevented from being lean, particularly when the engine is accelerated, so that an almost stoichiometric air-fuel ratio can be obtained.

According to the embodiment being considered, the deposited fuel quantity QMW is calculated using the predicted intake air quantity PMFWD and the engine speed NE, and the fuel deposition correction quantity FMW in a transient state is calculated by using the deposited fuel quantity QMW. Further, the deposit learning value KDPC obtained by the learning is calculated, and fuel is increased, within the predetermined period after the engine is started, on the basis of the deposit learning value KDPC obtained by the learning. With this structure, a saturated quantity of fuel is made to be deposited on the intake manifold wall in the steady operating state within the predetermined period after the engine is started. In this case, even when the engine is accelerated, the engine is supplied with an appropriate quantity of fuel. That is, the mixture is prevented from being lean in the accelerating state within the predetermined period after the engine is started, and drivability can be prevented from being deteriorated.

The present invention is not limited to the specifically disclosed embodiments, and variations and modifications may be made without departing from the scope of the present invention.

What is claimed is:

1. A fuel injection control apparatus for an internal combustion engine, comprising:

deposited fuel quantity calculating means for sequentially calculating a quantity of fuel deposited in an air intake system of the internal combustion engine in a stationary state on the basis of a value corresponding to a quantity of air taken in the air intake system and a speed of the internal combustion engine;

correction means for calculating a fuel deposition correction quantity on the basis of a difference between the quantity of fuel calculated this time and the quantity of fuel calculated at a previous time;

basic injection quantity calculation means for calculating a basic injection quantity on the basis of said value corresponding to the quantity of air taken in the air intake system and said speed of the internal combustion engine;

final injection quantity injection means for calculating a final injection quantity by correcting said basic injection quantity on the basis of the fuel deposition correction quantity and for injecting the final injection quantity of fuel into the internal combustion engine;

deposit detection means for detecting a quantity of a deposit deposited in the air intake system, said deposit containing carbon particles;

fuel increase correction means for increasing the basic injection quantity by an increased fuel quantity based on the quantity of the deposit; and control means for decreasing said increased fuel quantity used to correct the basic injection quantity when it is detected, within a predetermined period after the internal combustion engine is started, that the fuel increase correction means increases the basic injection quantity and the internal combustion engine is in an accelerating state.

2. The fuel injection control apparatus as claimed in claim 1, wherein said control means comprises means for inhibiting the fuel increase correction means from operating.

3. A fuel injection control apparatus as claimed in claim 1, wherein said deposit detection means comprises means for detecting said fuel deposit quantity from a concentration of oxygen in an exhaust manifold of the internal combustion engine.

4. A fuel injection control apparatus as claimed in claim 1, wherein said deposit detection means comprises means for detecting said fuel deposit quantity by determining whether a mixture of fuel and air is rich or lean, the control apparatus further comprising means for varying said fuel deposit quantity on the basis of the amount of fuel and air in the mixture.

5. A fuel injection control apparatus as claimed in claim 4, further comprising means for correcting said fuel deposit quantity on the basis of a temperature of water used for cooling the internal combustion engine, and the engine speed.

* * * * *